US006945920B1

(12) United States Patent
Kemery et al.

(10) Patent No.: US 6,945,920 B1
(45) Date of Patent: Sep. 20, 2005

(54) ADJUSTABLE BALANCING BOARD

(75) Inventors: Michael C. Kemery, Portland, OR (US); Tobin N. Guild, Portland, OR (US)

(73) Assignee: Nike International Ltd., Beaverton, OR (US)

( * ) Notice: Subject to any disclaimer, the term of this patent is extended or adjusted under 35 U.S.C. 154(b) by 0 days.

(21) Appl. No.: 10/668,036

(22) Filed: Sep. 22, 2003

(51) Int. Cl.[7] ..... A63B 22/16
(52) U.S. Cl. ..... 482/146; 482/147; 482/34
(58) Field of Search ..... 482/34, 146, 147, 482/148; 472/111, 106; 280/256, 625, 618, 280/617, 87.041, 87.042; 606/102; 473/324; 441/74, 79; 446/154; 36/93; 297/411.2

(56) References Cited

U.S. PATENT DOCUMENTS

| | | | | | |
|---|---|---|---|---|---|
| 3,024,021 | A | | 6/1962 | Coplin et al. | |
| 3,488,049 | A | | 1/1970 | Sasser, Jr. | |
| 3,531,110 | A | * | 9/1970 | Marchu | 482/71 |
| 3,895,794 | A | | 7/1975 | England | |
| 3,984,100 | A | | 10/1976 | Firster | |
| 4,191,371 | A | | 3/1980 | Armer, Jr. | |
| D255,372 | S | | 6/1980 | Tidmore | |
| 4,505,477 | A | | 3/1985 | Wilkinson | |
| 4,601,469 | A | | 7/1986 | Sasser, Jr. | |
| 4,708,339 | A | * | 11/1987 | Perrine | 482/71 |
| 4,759,542 | A | | 7/1988 | Hudec | |
| 4,826,159 | A | * | 5/1989 | Hersey | 482/146 |
| 5,152,691 | A | | 10/1992 | Moscarello | |
| 5,190,506 | A | | 3/1993 | Zubik et al. | |
| 5,292,296 | A | | 3/1994 | Davignon | |
| 5,328,421 | A | | 7/1994 | Stanalajczo | |
| 5,399,140 | A | | 3/1995 | Klippel | |
| 5,545,115 | A | | 8/1996 | Corcoran | |
| D376,629 | S | | 12/1996 | Mounts et al. | |
| 5,584,787 | A | | 12/1996 | Guidry | |
| 5,630,237 | A | | 5/1997 | Ku | |
| 5,643,164 | A | | 7/1997 | Teff | |
| 5,647,830 | A | | 7/1997 | Togao | |
| 5,730,690 | A | | 3/1998 | Guidry | |
| 5,755,651 | A | | 5/1998 | Homyonfer et al. | |
| 5,810,703 | A | * | 9/1998 | Stack | 482/146 |
| D405,135 | S | | 2/1999 | Scott | |
| 5,879,275 | A | * | 3/1999 | Aruin | 482/146 |
| 5,897,474 | A | * | 4/1999 | Romero | 482/146 |
| 6,017,297 | A | | 1/2000 | Collins | |
| 6,019,712 | A | | 2/2000 | Duncan | |

(Continued)

FOREIGN PATENT DOCUMENTS

GB 2139102 A * 11/1984 ..... A63B 23/04

*Primary Examiner*—Stephen R. Crow
*Assistant Examiner*—L. Amerson
(74) *Attorney, Agent, or Firm*—Shook, Hardy & Bacon, L.L.P.

(57) ABSTRACT

A balancing board allowing for selection of a desired degree of stability is disclosed. The balancing board has a platform and a hemispherical fulcrum slidably mounted to platform and bifurcated into a pair of pivot members. Each pivot member is independently positionable along an underside of the platform opposite of an engagement surface upon which a user positions themselves to practice balancing training techniques. When the pivot members are slid together, the balancing board is freely pivotable about any axis in the plane of the surface on which the pivot members are resting. Conversely, when the pivot members are spaced apart from each other, the balancing board resists pivoting in a direction aligned with the axis along which the pivot members are slidable.

15 Claims, 3 Drawing Sheets

U.S. PATENT DOCUMENTS 6,146,343 A * 11/2000 Stewart ..... 601/118
6,413,197 B2 7/2002 McKechnie et al.
6,436,012 B1 * 8/2002 Naville ..... 482/77
6,461,285 B1 10/2002 Theunissen et al.
2002/0151417 A1 * 10/2002 List ..... 482/123
2004/0009859 A1 * 1/2004 Gottlieb ..... 482/146

* cited by examiner

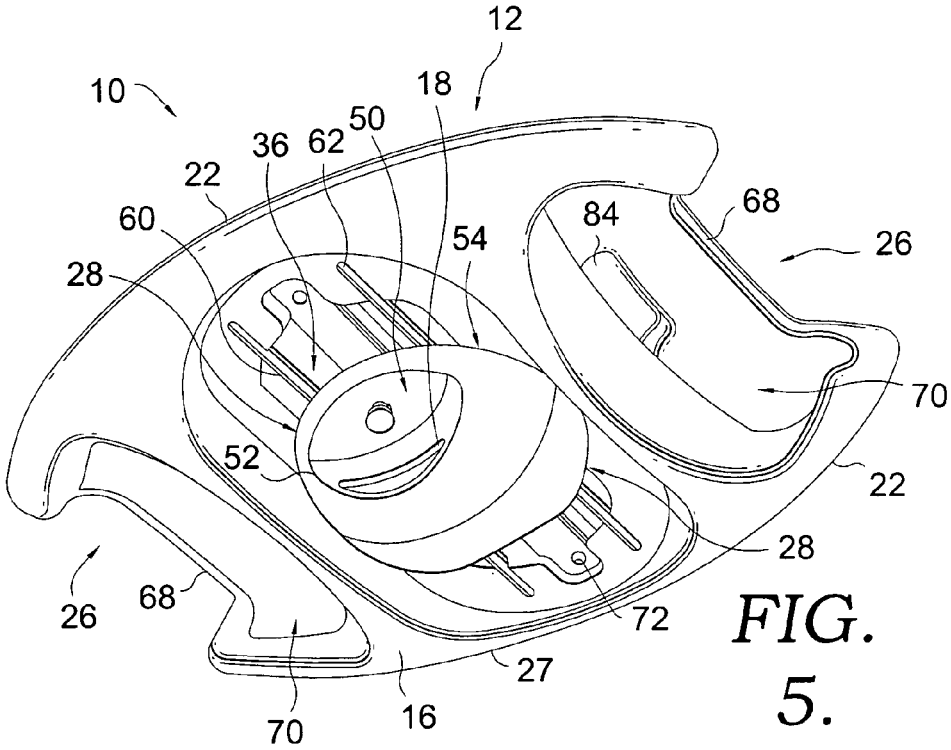
FIG. 5.
FIG. 6.
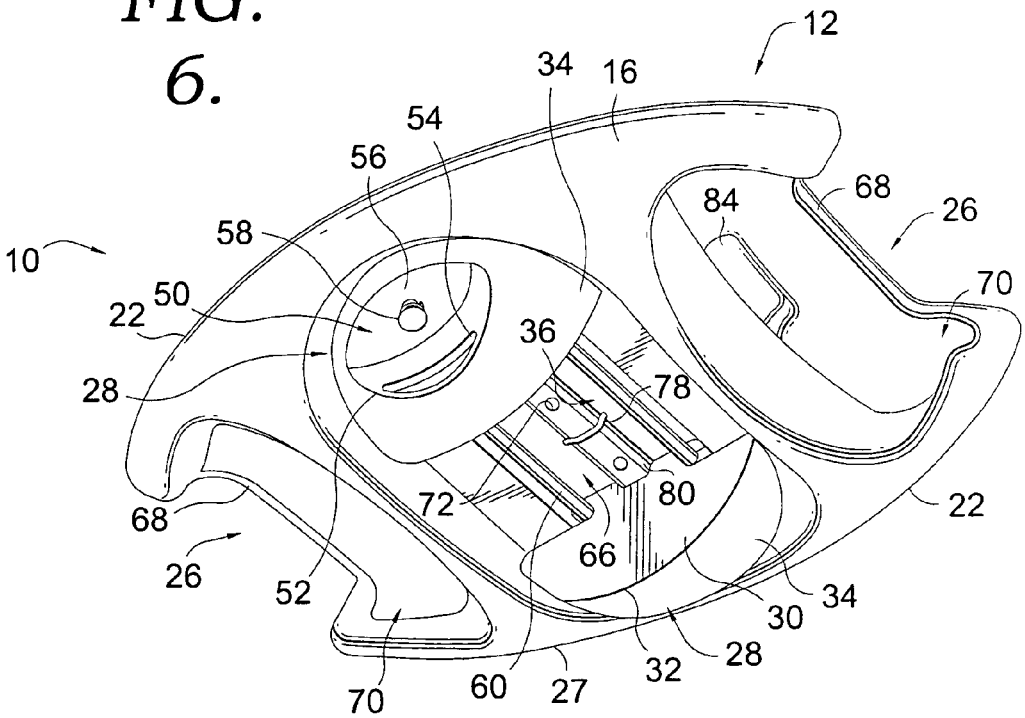

ADJUSTABLE BALANCING BOARD

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The invention relates generally to equipment for assisting in improving balance, and more particularly, to a balancing board with an adjustable pivot to vary the difficulty of balance for the user.

2. Discussion of the Related Art

Balancing boards of various designs have been used for years to strengthen and train a person's muscle groups to maintain their body in balance. One popular design for a balancing board consists of a platform on which a person will stand and a stationary fulcrum attached to a center point of a bottom surface of the platform. In use, the fulcrum contacts a surface (e.g., a floor or the ground) on which the balancing board is supported, and may take on a variety of shapes, such as a partial hemisphere, a full or partial cylinder axially aligned in the horizontal plane, or other shapes having a curved or angled surface extending below the platform bottom surface. With a balancing board having a fixed fulcrum and a hemispherically-shaped surface, the board is pivotable to some degree about any axis in the plane of the surface upon which it is resting; if the fixed fulcrum instead has a cylindrically-shaped surface, the board is pivotable about the longitudinal axis of the fulcrum and may only be pivotable about a transverse axis in the plane of the surface if the user positions their center of gravity outwardly towards a perimeter of the platform at or beyond a point vertically above the end of the fulcrum. Another balancing board design implements a moveable fulcrum in place of a stationary fulcrum. One example of a movable fulcrum includes a roller or wheel rotatable along the bottom surface of the platform. Because the movable fulcrum may be disposed at a location away from the center point of the bottom surface of the platform, thereby providing no vertical support beneath the center of gravity of the platform, more challenge is introduced to the user to maintain their balance while keeping the platform in equilibrium above the surface upon which the fulcrum is resting.

Further advancements have led to balancing boards designs that have an adjustable range of difficulty. As an example, U.S. Pat. No. 5,810,703, issued to Stack, provides a balancing board with a fulcrum having a hemispherically-shaped contact face and a spacer placed between the fulcrum and the platform. The spacer allows the contact face to be positioned at various heights relative to the platform such that varying degrees of allowable rotation of the platform about any axis in the horizontal plane are realized. Novices would select a smaller degree of rotation such that if they were to get out of balance while using the balancing board, the perimeter of the platform would quickly contact the surface upon which the fulcrum is resting and allow them to easily regain their balance. Alternatively, a larger degree of rotation would be selected by more experienced users who wish to regain their balance more by using their own muscles and less with the aid of the platform.

While the balancing board of Stack provides general balancing difficulty adjustment, such an adjustment can only be made for all directions of rotation about any axis in the plane of the surface upon which the fulcrum is resting, and with the same degree of rotation. This is problematic for a user who wishes to increase difficulty in one direction of rotation, such as fore and aft rotation, while selecting a different level of difficulty in another direction of rotation, such as lateral rotation. Other balancing boards employing a moveable fulcrum have some degree of balancing difficulty adjustment, but these devices involve rather complicated designs with a number of moving parts to maintain, and generally do not provide for separately adjusting the difficulty of balance depending on the particular axis in the plane of the surface about which the board is rotating.

BRIEF SUMMARY OF THE INVENTION

An adjustable balancing board is provided with a selectively controllable degree of stability. The balancing board is formed of a platform on which a hemispherical fulcrum is mounted, the hemispherical fulcrum being bifurcated into separate pivot members each independently slidable along an underside of the platform. When the pivot members are slid together to form the complete hemispherical fulcrum, the balancing board resting on a surface is pivotable within a range of rotational values about any axis in the plane of the surface. Conversely, when the pivot members are slid apart from each other, the balancing board is freely pivotable within a range of rotational values about a first axis in the plane of the surface, but resists pivoting about a second axis in the plane of the surface orthogonal to the first axis. This allows a user standing on the platform to select, for example, more stability in the fore and aft direction and less stability in the lateral direction such that balance training will focus more on muscle groups that control lateral balance.

In one aspect, handles are disposed at opposed ends of the platform. The handles are formed by recessed end regions of the platform extending inward towards a center of the platform and cavities in the underside of the platform proximal to the end regions. The user can grasp the handles when supporting their upper body over the platform (e.g., in a "push up" type position) to improve upper body balance, or when sitting on the platform to aid in stabilizing their torso when developing seated balance.

In another aspect, each of the pivot members has a lock to secure the selected position of the member on the underside of the platform. This ensures that the balance training scheme chosen can be repeated until a scheme with a different degree of instability is desired. Additionally, a depression may extend into each pivot member to form a handle that may be grasped to slide the respective pivot member along the underside of the platform.

BRIEF DESCRIPTION OF THE SEVERAL VIEWS OF THE DRAWING

FIG. 5 is a bottom perspective view of the adjustable balancing board showing the pivot members abutting one another to form the hemispherical fulcrum; and FIG. 6 is a bottom perspective view of the adjustable balancing board showing the pivot members separated from one another.

DETAILED DESCRIPTION OF THE INVENTION

Figure 2:
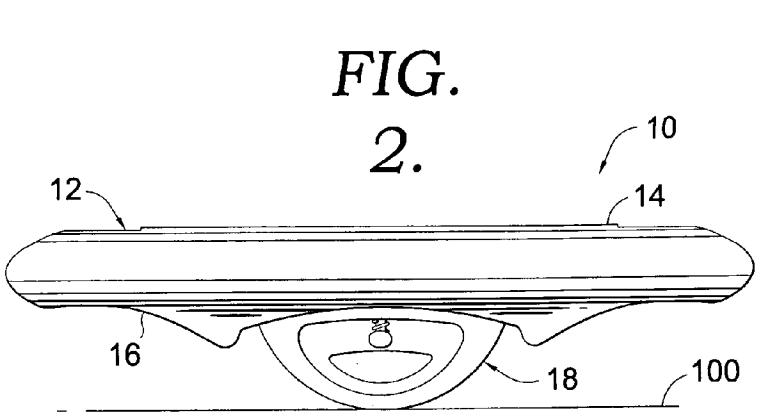
FIG. 2 is a side elevational view of the adjustable balancing board.
Figure 1:
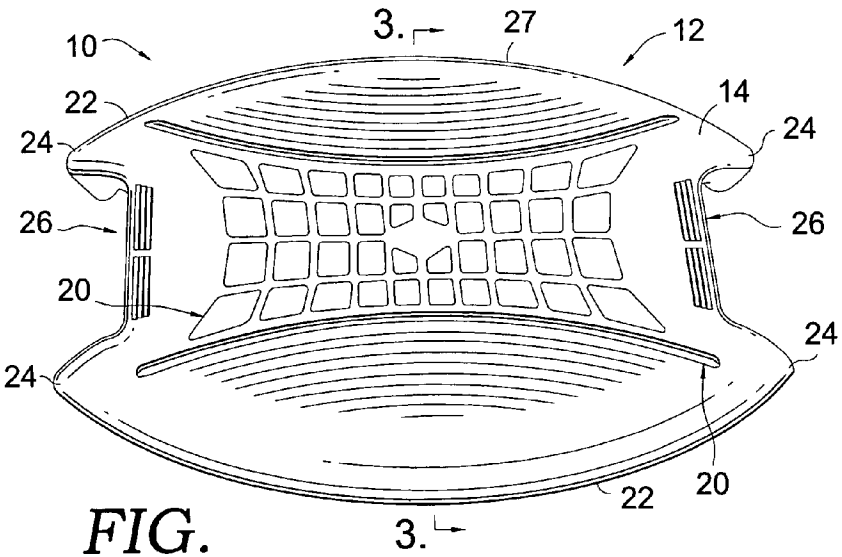
FIG. 1 is a top perspective view of the adjustable balancing board in accordance with one embodiment of the invention.

FIGS. 1 and 2 show generally the adjustable balancing board 10 of one embodiment of the present invention. A platform 12 presents a top engagement surface 14 onto which a user will position themselves and an underside or bottom surface 16 onto which a hemispherical fulcrum 18 is slidably mounted. The hemispherical fulcrum 18 is configured to contact a surface 100 for pivoting thereon when a user is positioned on the top engagement surface 14 of the platform 12.

The platform 12 may be fabricated as a single piece of molded plastic such that it can be shaped into the desired configuration. Numerous gripping elements 20 (e.g., ridges and grooves) are formed onto the top engagement surface 14 of the platform 12 in various patterns to provide traction for the user's footwear, hands, or other parts of their body resting on the surface 14. To provide a smooth boundary limit for pivoting about the hemispherical fulcrum 18, the platform 12 has a pair of arcuate side edges 22. If the user situated on the platform top engagement surface 14 tilts the platform 12 sufficiently enough from the orientation shown in FIG. 2 that the platform would contact the surface 100, the arcuate side edges 22 would roll against the surface 100 and allow the user to easily regain their balance and return the platform to a level state. The arcuate side edges 22 have terminal ends 24 bridged therebetween across the platform 12 by opposed end regions 26. The arcuate side edges 22 and opposed end regions 26 define a perimeter 27 for the platform 12.

Figure 3:
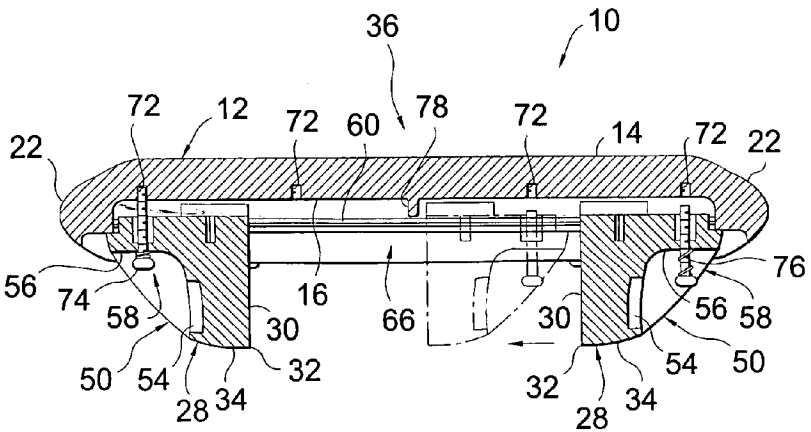
FIG. 3 is a cross-sectional view of the adjustable balancing board taken along line 3—3 showing the motion of the pivot members along the linear track.

FIG. 3 shows how the hemispherical fulcrum 18 is dividable into more than one pivot member 28 so as to alter the stability of the balancing board. More specifically, the hemispherical fulcrum 18 is bifurcated along a radial plane into two pivot members 28 each having an abutting surface 30 along the radial plane extending to a pivot member apex 32 and a half-dome like shaped contact face 34 for resting on the surface 100. A linear track 36 extends laterally across the bottom surface 16 of the platform 12 with each pivot member 28 slidably mounted onto the track 36. Through the motion of each pivot member 28 towards or away from each other on the linear track 36, the stability of the balancing board 10 is altered. For example, if the pivot members 28 are positioned with their respective abutting surfaces 30 adjacent to one another, the complete hemispherical fulcrum 18 is formed and the platform 12 will be relatively unstable and freely pivotable (assuming the surface 100 is relatively flat) about any axis in the plane on which the pivot members 28 are resting (e.g., horizontal plane along surface 100). On the other hand, if the pivot members 28 are slid apart from one another, the platform 12 will resist pivoting in a direction aligned with the longitudinal axis of the linear track 36 unless the user positions their center of gravity outwardly towards the platform perimeter 27 at or beyond a point above the pivot member apex 32.

Figure 4:
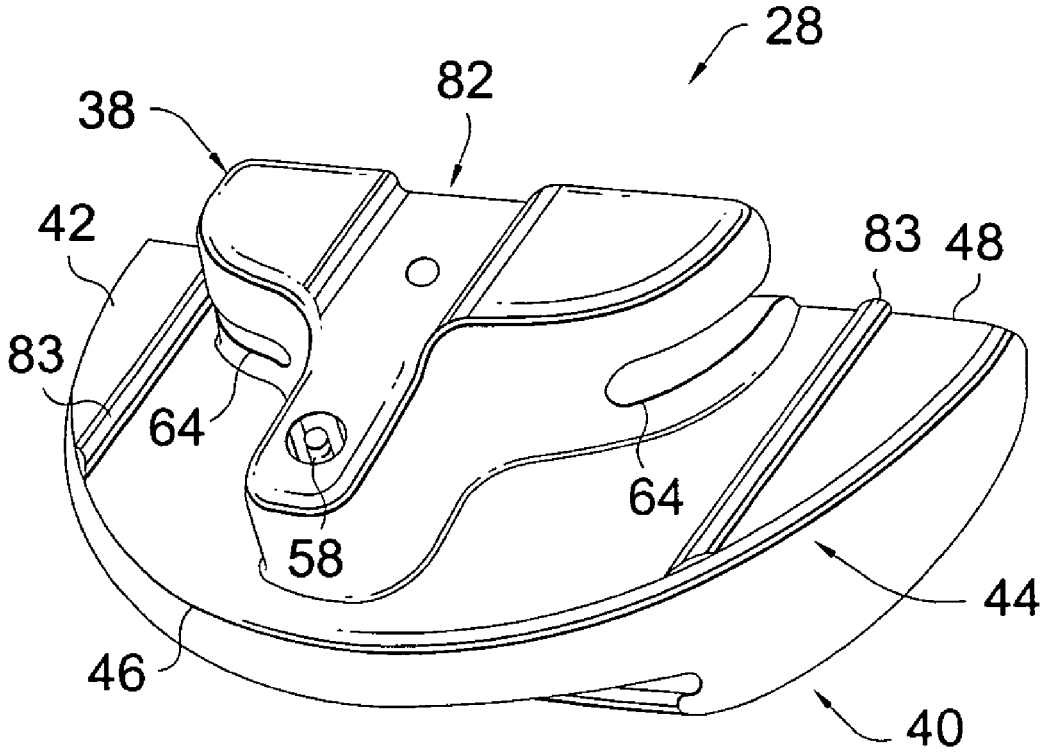
FIG. 4 is a top perspective view of one pivot member.

The pivot members 28 and their movement along the bottom surface 16 of the platform 12 are shown in more detail in FIGS. 4–6. Each pivot member 28 has an upper mounting region 38 and a lower body region 40 whereon the half-dome contact face 34 is disposed. Opposite of the half-dome contact face 34 on the lower body region 40 is a top planar surface 42 with a perimeter edge 44 defined by a first arcuate section 46 and a second linear section 48. The upper mounting region 38 is disposed on the top planar surface 42 inwardly from the first arcuate section 46 of the perimeter edge 44. A depression 50 is formed in the half-dome contact face 34 of the lower body region 40. The depression 50 shares a curved boundary edge 52 with the half-dome contact face 34 so that if a user pivots the balancing board 10 a degree sufficient to move the depression 50 into facing relation with the surface 100, the board 10 will roll onto the boundary edge 52 and maintain a smooth surface for pivoting. Preferably, a pivot member cavity 54 is formed in the depression 50 extending laterally inward into the member 28 to serve as a handle so that a use may insert their fingers into the pivot member cavity 54 and grasp the member 28 for sliding thereof to the desired location on the linear track 36.

As best seen in FIG. 3, the depression 50 in the pivot member 28 forms a lip 56 through which a locking pin 58 is extended. The locking pin 58 preferably has a threaded section for being received by threaded bores 72 on the platform bottom surface 16. A handle 74 is formed on the locking pin 58 to aid in rotating the pin 58 into and out of mounting with the threaded bore 72 to fixedly position the respective pivot member 36 along the platform bottom surface 16. A spring 76 is also provided and is mounted around the locking pin 58 between the pivot member lip 56 and the pin handle 74 to bias the pin 58 away from the platform bottom surface 16 so that the pin 58 does not drag along the bottom surface 16 as the pivot member 28 is slid along the linear track 36. The threaded bores 72 may be located at any position along the platform bottom surface 16, and preferably are located as allow the pivot members 36 to be locked at a specific position either in an abutting, or immediately adjacent, relationship with one other, or in a spaced apart relationship where at least one of the pivot members 36 is disposed proximal to the platform perimeter 27 (as shown in FIG. 6). A stop 78 is also located on the platform bottom surface 16 to limit the range of movement of the pivot members 36 and to set the location of the pivot members 36 when in an abutting, or immediately adjacent, relationship, so that the hemispherical fulcrum 18 is generally centered underneath the center of the platform 12.

The linear track 36 of the platform 12 preferably takes the form of a pair of cylindrical rails 60 with ends thereof that are positioned in slots 62 formed in the platform bottom surface 16. The rails 60 may "snap-in" to the slots 62 so that the rails are removably mounted with the slots 62 to allow swapping out or replacement of the pivot members 28, or the rails 60 may be permanently mounted within the slots 62. As best seen in FIG. 4, to mount with the rails 60, the upper mounting region 38 of each pivot member 28 has opposed slots 64 extending inward from a perimeter thereof in a direction orthogonal to the longitudinal axes of the rails 60. To provide the balancing board 10 with a low-profile, the rails 60 and upper mounting region 38 of the pivot members 28 are substantially disposed with a platform cavity 66 formed in the bottom surface 16 of the platform 12. The platform cavity 66 has a major dimension extending parallel to the longitudinal axes of the rails 60. A ridge 80 is formed in the platform cavity 66 parallel to the rails 60 and receives a groove 82 formed in the upper mounting region 38 of the pivot member 28. Furthermore, raised rails 83 are formed along the top planar surface 42 of each pivot member 28 and extend in a direction parallel to the groove 82. These rails 83 serve to limit the clearance between the pivot member top planar surface 42 and the platform bottom surface 16 to reduce undesirable "rock" or twisting of the pivot members 28.

To assist the user in maintaining balance while positioning themselves on the balancing board 10, or otherwise supporting a portion of their body on the board, a pair of handles 68 are provided. Specifically, the handles 68 are formed by the platform end regions 26 being recessed laterally inward towards a center of the platform 12 and a pair of depressions 70 of the platform bottom surface 16 extending to the end regions 26. Optionally, to provide additional leverage for gripping, handle cavities 84 may be formed in the depression into which a user can insert their fingertips when holding onto the end regions 26.

In use, a user may position their body on the balancing board 10 in a variety of ways to develop various muscle groups for improving balance. For example, a user can grasp the handles 68 and engage in a "push up" type motion on the balancing board 10, or can sit on the board 10 and grasp the handles 68 to better brace themselves when practicing sitting balance techniques, or can further stand or squat on the board 10 only touching with their feet. If a more difficult balancing training regime is desired, or otherwise all directions of balance are to be trained at one, the pivot members 28 will be positioned to form the complete hemispherical fulcrum as shown in FIG. 5. The pivot members 28 may alternatively be independently slid along the rails 60 and locked into place at the desired position by the locking pins 58, as shown in FIG. 6, to provide stability against pivoting of the platform 12 in a direction aligned with the longitudinal axis of the rails 60.

Thus, balance training with the balancing board 10 may be tailored to the desired degree of difficulty and to the various muscle groups that are to be exercised to improve various forms of balance (e.g., fore and aft, lateral, etc.). The ease of adjustment of the pivot members 28 ensures that any user can quickly select the desired amount of stability for the balancing board 10.

Since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. An apparatus for improving a user's balance by providing a selectively controllable degree of stability for the apparatus when positioned on a reference surface and supporting a user thereon, the apparatus comprising:

a platform having a top engagement surface and a bottom surface; and a hemispherical fulcrum coupled with the bottom surface of the platform and being bifurcated into separate pivot members, each pivot member having a contact face and being movable between a first position wherein the pivot members abut one another to present the contact faces generally as a continuous dome shape for resting on the reference surface, and a second position wherein the pivot members are spaced from one another to present two separate half-dome shaped contact faces for resting on the reference surface, the pivot members being operable to provide increased stability for the platform when in the second position.

2. The apparatus of claim 1, further comprising a linear track extending laterally across the bottom surface of the platform, the pivot members being slidably mounted to the linear track for movement along the track to the second position to offer increased stability for the platform in a direction aligned with a longitudinal axis of the linear track.

3. The apparatus of claim 1, further comprising a lock mounted with each pivot member to secure a selected position of the respective pivot member on the bottom surface of the platform.

4. The apparatus of claim 3, wherein the lock comprises:

a pin having a threaded section and a handle, and extending through the pivot member; and a spring mounted around the pin between the pivot member and the pin handle to bias the pin away from the platform bottom surface;

and wherein the platform bottom surface has a series of threaded bores to threadingly receive the pin threaded section to secure the pin to the bore and the pivot member at the selected position.

5. The apparatus of claim 1, further comprising a stop to limit the range of movement of the pivot members along the platform bottom surface and to set the location of the pivot members first position.

6. The apparatus of claim 1, wherein the platform has a pair of arcuate side edges bridged on ends thereof by a pair of opposed ends regions recessed inwardly towards a center of the platform.

7. The apparatus of claim 6, wherein a pair of outer depressions are formed in the bottom surface of the platform proximal to the end regions to form the end regions into a set of handles.

8. The apparatus of claim 2, wherein the pivot members each have a cavity formed in the half-dome shaped contact face to form a recessed handle that may be grasped to slide the pivot member along the linear track.

9. A balancing device comprising: a platform having an engagement surface and an underside surface whereby a user may be positioned on said engagement surface; at least two pivot members, each having a rounded contact face for resting on a reference surface; and means for slidably mounting the pivot members to said underside of said platform such that the pivot members may be moved laterally to a first position proximal to one another and a second position distal to one another; whereby in the first position said pivot members combine to form a generally hemispherical fulcrum; and whereby the second position allows increased stability for the platform in one direction over said first position.

10. The device of claim 9, wherein the means for slidably mounting the pivot members with the underside of the platform further allows the movement of the pivot members to a third position offering increased stability for the platform in one direction over the first position but less stability than the second position.

11. The device of claim 9, wherein the pivot members comprise a lower body region whereon the contact face is formed and an upper mounting region, the means for slidably mounting the pivot members comprising:

a linear track extending laterally across the underside of the platform; and a set of slots formed in the upper mounting region of each pivot member for accepting the linear track therein;

wherein the second position offers increased stability for the platform in a direction aligned with a longitudinal axis of the linear track.

12. The device of claim 9, further comprising a lock mounted with each pivot member to secure the selected position of the respective pivot member on the underside of the platform.

13. The device of claim 9, wherein the platform has a pair of arcuate side edges bridged on ends thereof by a pair of ends regions recessed inwardly towards a center of the platform.

14. The device of claim 13, wherein a pair of outer depressions are formed in the underside of the platform proximal to the end regions to form the end regions into a set of handles.

15. The device of claim 11, wherein the pivot members each have a cavity formed in the half-dome like shaped contact face to form a recessed handle that may be grasped to slide the pivot member along the linear track.

* * * * *